US005079087A

United States Patent [19]

Lever et al.

[11] Patent Number: 5,079,087

[45] Date of Patent: Jan. 7, 1992

[54] PROCESS FOR MAKING METAL SURFACES HYDROPHILIC AND NOVEL PRODUCTS THUS PRODUCED

[75] Inventors: Gordon Lever; Frank N. Smith, both of Kingston; Gregory J. Courval, Napanee; Joseph Hron, Kingston, all of Canada

[73] Assignee: Alcan International Limited, Montreal, Canada

[21] Appl. No.: 571,835

[22] Filed: Aug. 22, 1990

Related U.S. Application Data

[63] Continuation of Ser. No. 182,976, Apr. 18, 1988, abandoned.

[30] Foreign Application Priority Data

Apr. 24, 1987 [CA] Canada ..... 535497

[51] Int. Cl.[5] ..... B32B 5/16

[52] U.S. Cl. ..... 428/329; 165/133; 422/7; 427/190; 428/336; 428/472.2

[58] Field of Search ..... 427/386, 387, 388.1, 427/388.2, 388.3, 388.4, 388.5, 190; 428/329, 336, 418, 457, 463, 472.2; 165/133; 422/7

[56] References Cited

U.S. PATENT DOCUMENTS 4,181,773 1/1980 Rickert ..... 422/386 X 4,405,493 9/1983 Pippard ..... 106/14.39 X

OTHER PUBLICATIONS

Misra, Chanakya, *Industrial Alumina Chemicals,* 1986.

*Primary Examiner*—Michael Lusignan

*Attorney, Agent, or Firm*—Cooper & Dunham

[57] ABSTRACT

The surfaces of articles of manufacture fabricated from aluminum or other metals which are not permanently hydrophilic are made permanently hydrophilic by coating the surfaces with a continuous film containing particles of activated alumina. The coated articles are not only hydrophilic, but also have good corrosion resistance and exhibit low abrasiveness, resulting in decreased wear on manufacturing tools, such as dies.

12 Claims, 2 Drawing Sheets

-100X-

-100X-

-20X-

-100X-

-100X-

PROCESS FOR MAKING METAL SURFACES HYDROPHILIC AND NOVEL PRODUCTS THUS PRODUCED

This is a continuation of application Ser. No. 182,976, filed Apr. 18, 1988, now abandoned.

This invention relates to a method of surface treatment for metal articles, and particularly the fins which form the heat radiating and cooling parts of an aluminum heat exchanger.

Conventionally, many heat exchangers have been constructed with a very narrow fin spacing whereby the surface areas of the heat radiating part and the cooling part are as large as possible in order to improve the heat radiating or cooling effect. When these devices are used for cooling purposes, moisture in the atmosphere condenses on the heat exchange surface and particularly in the spaces between the fins. This condensed water readily forms spherical drops as the surface of the fins has a hydrophobic nature and these water droplets interfere with air flow in the spaces between the fins.

Various methods have been mentioned to make surfaces more hydrophilic and, for instance, U.S. Pat. No. 4,181,773 describes a process for applying a continuous film containing colloidal α-alumina. Other methods of making metal surfaces hydrophilic include the application of silicate-containing coatings, the application of coatings containing finely ground ion exchange resins, etc. Electrochemical methods may also be used, such as anodizing and electrograining, or the metal surface may be treated in boiling water and hot aqueous solutions to produce a boehmite surface layer.

All of the above methods have disadvantages. The electrochemical methods require careful process control and choice of metal quality. Coatings containing silicates, ion exchange resin particles or boehmite can cause excessive wear on tooling when the coated metal is formed.

It is the object of the present invention to provide an effective hydrophilic surface on metal articles which surface will also have the advantage of avoiding excessive wear on tools used to form and fabricate the coated articles and also improve the corrosion resistance of the materials.

SUMMARY OF THE INVENTION

According to one embodiment of the present invention there is provided a method for treating the surface of metal articles, such as aluminum heat exchangers, which comprises applying a continuous coating thereto comprising fine particles of activated alumina.

Activated alumina is a high surface area alumina formed by rapid calcination of hydrated alumina at a temperature below that required for complete dehydration. Typically, this type of alumina is amorphous or has a microcrystalline structure (as determined by XRD), has a high porosity and specific surface area, has a particle size less than 10 microns and is readily dispersible in aqueous or certain polar organic solvents.

A suitable activated alumina can be prepared by flash calcining an alumina trihydrate to give a product with loss on ignition (LOI) of about 4 to 10%. This material, which is commonly known as activated alumina, has a weak XRD pattern, a surface area of greater than 200 $m^2/g$ and a high porosity. Compared to α-alumina, it is relatively non-abrasive and friable. This material is ground in an aqueous or polar organic solvent with or without peptizing (dispersing) agents to give a highly dispersible activated alumina. After grinding, the particles normally have a size of less than 10 microns, and preferably less than 2 microns.

Coatings containing activated alumina can be applied to metal surfaces using standard methods, such as spraying, brushing, roller coating, dipping, silk screening, etc., followed by an appropriate drying process.

It is also possible to utilize activated alumina in coating compositions in which it is incorporated into an organic binder resin. The resin contributes to the corrosion protection of the metal and helps to bind the finely dispersed alumina to the metal substrate. The resin can be an acrylic, polyester, epoxy or any other type of organic film forming resin which is compatible with the dispersed alumina. The resin can be either an air dry or bake type. The ratio of resin solids to alumina can vary from 10–90 to 70–30 by weight and is typically from 30–70 to 60–40.

The coating is prepared by blending the alumina dispersion with a resin solution containing the organic resin, solvent and other coating ingredients as required, such as dispersion stabilizers, cosolvents, catalysts, plasticizers and cross-linking agents. Blending is carried out on a high shear mixer such as a dispersator. For laboratory testing, the coating may be applied to test coupons using a draw down bar or by spray application. On a production scale, the coating may be applied by any conventional coating procedure such as roller coating, dipping, spraying, brushing or silk screen. The dry coating thickness is typically in the range of 1–20 microns, with about 2 to 5 microns being preferred.

Surfaces of metal articles of manufacture treated according to this invention not only show good hydrophilic characteristics, but also exhibit improved corrosion resistance and low abrasiveness resulting in decreased wear on manufacturing tools, such as a fin forming die. Accordingly, the coating of activated alumina may be applied to aluminum finstock before or after forming or as a post-treatment to a completed heat exchanger.

In the drawings which illustrate this invention:

Figure 1:
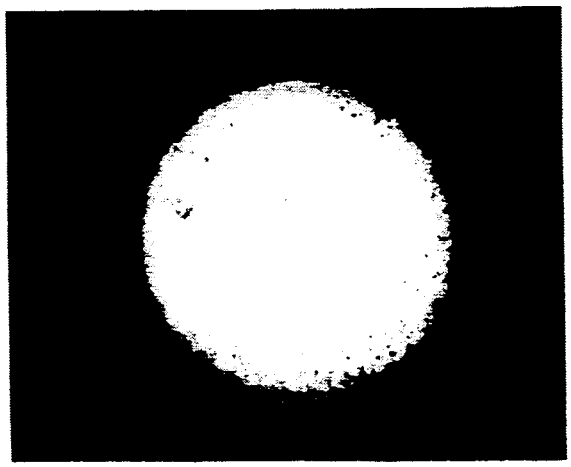
FIG. 1 is a photomicrograph of an unused ball bearing of a pin-on-disc abrasion tester.

The present invention and improvements resulting therefrom will be more readily apparent from a consideration of the following illustrative examples.

EXAMPLE 1

(a) Preparation of Activated Alumina

Flash activated Bayer trihydrate was rapidly heated to give a loss on ignition of 4 to 10%. This was placed in 60 litres of deionized water in a 200 litre plastic drum. To this was added 230 ml of $HNO_3$ (70%) followed by 50 kg of flash activated alumina (FAA). The above mixture was stirred for 15 minutes and then allowed to settle.

Water was decanted off and then fresh water was added up to the original volume. This was stirred for 5 minutes and then allowed to settle. Again, water was decanted off and the solids were transferred to trays filling to about 1 inch. This was dried in a recirculation type oven at 100° C. to obtain an alumina having a loss on ignition of 14.5% and a $Na_2O$ content of 0.074%.

(b) Dispersible Alumina in Methanol 685.7 Grams of the low soda flash activated alumina obtained above was placed in a one gallon attritor mill and 2.75 litres of methanol was added. The slurry was then ground for 4 hours and the product obtained was a highly dispersible alumina that did not settle out after several weeks.

(c) Dispersible Alumina in Water

A water dispersible product was made in a similar manner to the above product by replacing the methanol with water and grinding in the presence of up to 0.08 moles $HNO_3$/mole mole AlOOH. The dispersibility can be increased even further by autoclaving the ground slurry at about 180° C. for several hours.

EXAMPLE 2

A dispersion of alumina in water prepared as described in Example 1 above was applied to a sheet of aluminum using a roller and silk screen. This formed a thin coating on the aluminum and the coating was dried by placing the sheet in an oven at 200° C. To increase the adhesion of the coating, the sheet was passed through a small rolling mill having polished steel rollers to give a very slight reduction in thickness. The rolling forced the alumina particles into the metal surface and produced a coating with good adhesion.

To demonstrate the hydrophilic nature of this coating, a water drop test was carried out. Upon contacting the alumina coating, a water drop very rapidly spread across the coating. In contrast, a water drop on the aluminum metal surface remained in a discrete bead and did not wet the surface.

EXAMPLE 3

A coating composition was prepared using a methanol dispersion of activated alumina prepared according Example 1. This methanol dispersion contained 20% by weight of activated alumina. The composition contained the following components:

| | |
|---|---|
| methanol dispersion of activated alumina (20% by weight) | 450 parts |
| acrylic resin solution* (65% by weight) | 65 parts |
| crosslinking agent (Cymel 301 ®) | 10.5 parts |
| catalyst (Cycat 4040 ®) | 1.0 parts |
| butyl cellosolve | 1.25 parts |
| dimethylaminoethanol | 5.5 parts |

*40-425 from Reichhold Limited

Aluminum test coupons were coated with the above composition using a draw down bar. Cure was achieved by subjecting the coated coupons to 210° C. peak metal temperature.

Wettability

The hydrophilic nature of the coating was determined by spraying water from a squeeze bottle onto the test specimens. The water spread easily over the surface and did not break up as it would with a hydrophobic surface.

An alternative test method consisted of dipping test coupons into a beaker of water. Again, the water did not bead up, indicating that the surface was hydrophilic.

Adhesion

Adhesion of the coating to the substrate was measured by cross hatching the coating with a series of lines 2 mm apart. Tape applied over the cross hatched surface and quickly pulled off did not remove any of the coating, indicating excellent adhesion.

*Corrosion Resistance* [ASTM B117—Salt Spray (Fog) Testing]

The corrosion preventative nature of the aluminaorganic binder coating was determined by submitting coated test coupons to a neutral salt spray test. The salt solution was 5% sodium chloride. The coupons were scribed so that the metal under the coating was exposed to the salt solution. Samples were inserted into the salt spray cabinet and examined at regular intervals. Wettability was measured at the same time. Using a coupon coated with a 5 micron layer, after 500 hours exposure to salt spray the coating still provided excellent corrosion protection and the surface of the coupon remained wettable.

Solvent Resistance

Solvent resistance of the coating was determined by immersing test coupons into trichloroethylene at 80° C. for 5 minutes. The coating was unaffected by this procedure, i.e. no coating was removed from the substrate and the wettability remained unchanged. This procedure was repeated on test coupons that had been dipped into a lubricating oil. After removal of the lubricant with trichloroethylene at 80° C., the properties of the coating were unaffected.

Abrasiveness

The coating was also tested for abrasiveness because an important consideration for precoated finstock is the effect of the coating on metal-forming machinery, such as fin-forming machinery. This is particularly important for coatings containing inorganic pigments as the pigments may be abrasive to the tooling. The degree of abrasion that could be expected from the activated alumina coatings was measured using a pin-on-disc abrasion tester. This device applied a set loading (220 g) onto a pin which had a stainless steel ball bearing (3 mm diameter) at the tip. The pin rested on a disc of the coated test coupon. The disc was rotated at a set speed (40 rpm) for a set time period (20 minutes). The pin was attached to an arm which moved across the disc as the disc rotated so as to cover a wide area of the disc. At the end of the experiment, the ball bearing was examined under a microscope to determine the degree of abrasion which had occurred. This showed the coating to have excellent abrasion resistance.

EXAMPLE 4

Using the same general procedure as described in Example 3, four different coatings were tested. These included the same activated alumina composition described in Example 3 and three other compositions in which the activated alumina was replaced by (1) $\alpha$-alumina [Alcan C72FG], (2) magnesium silicate [Cyprus Industrial Minerals Company]and (3) activated alumina [300A available from Kaiser Aluminium]. All materials were ground to an average particle size in the range of 1.5–3 $\mu$m and a dispersion of each was prepared according to the procedure of Example 3.

Aluminum test coupons were coated with the four compositions using a draw down bar. Drying and cure was achieved for all specimens by subjecting coated coupons to a peak metal temperature of 210° C.

The coatings were tested for abrasiveness using a pin-on-disc abrasion tester and the same test procedure described in Example 3. At the end of the experiment, the ball bearings used to test each coating were examined under a microscope and the results are shown in FIGS. 1–5.

Figure 2:
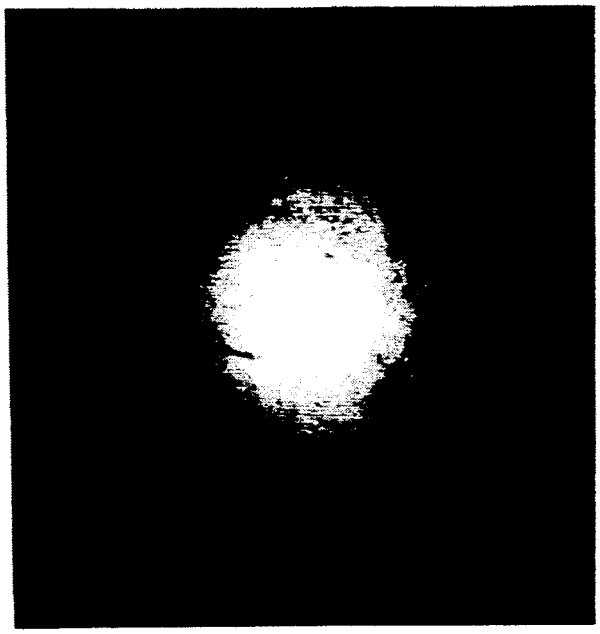
FIG. 2 is a photomicrograph of a ball bearing tested with an activated alumina coating of this invention.
Figure 3:
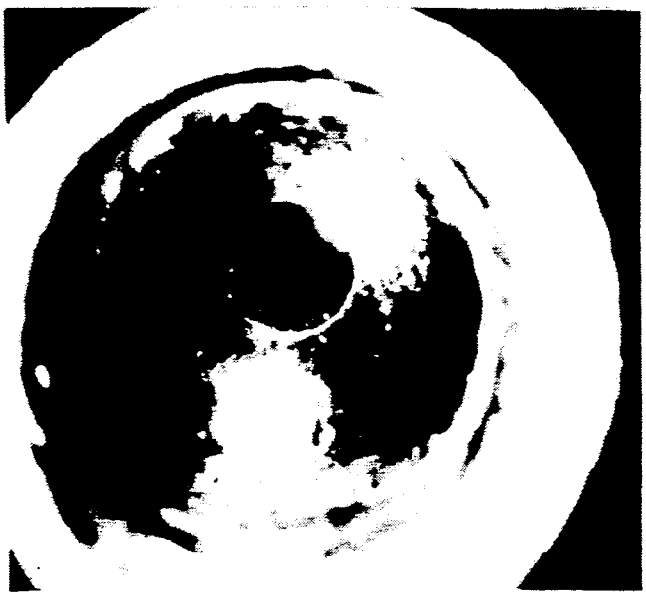
FIG. 3 is a photomicrograph of a ball bearing tested with an α-alumina coating.
Figure 4:
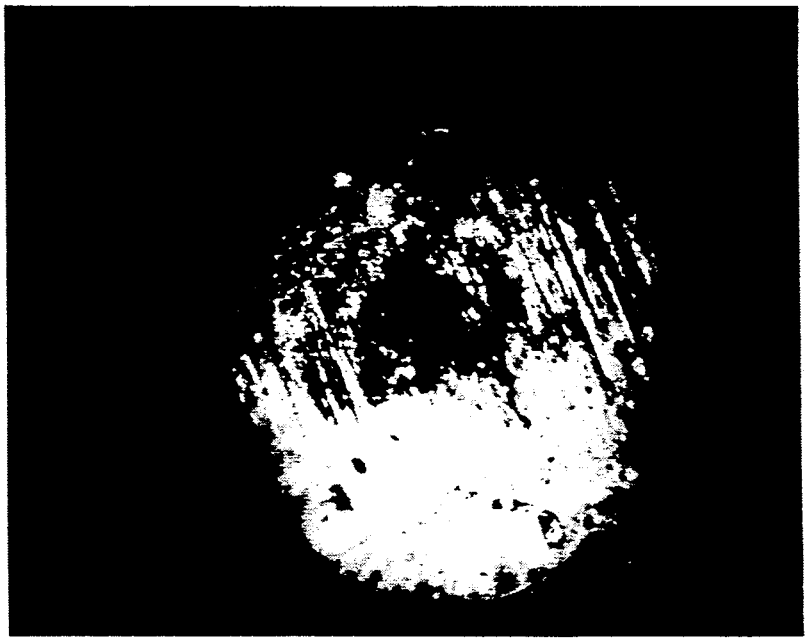
FIG. 4 is a photomicrograph of a ball bearing tested with a magnesium silicate coating.
Figure 5:
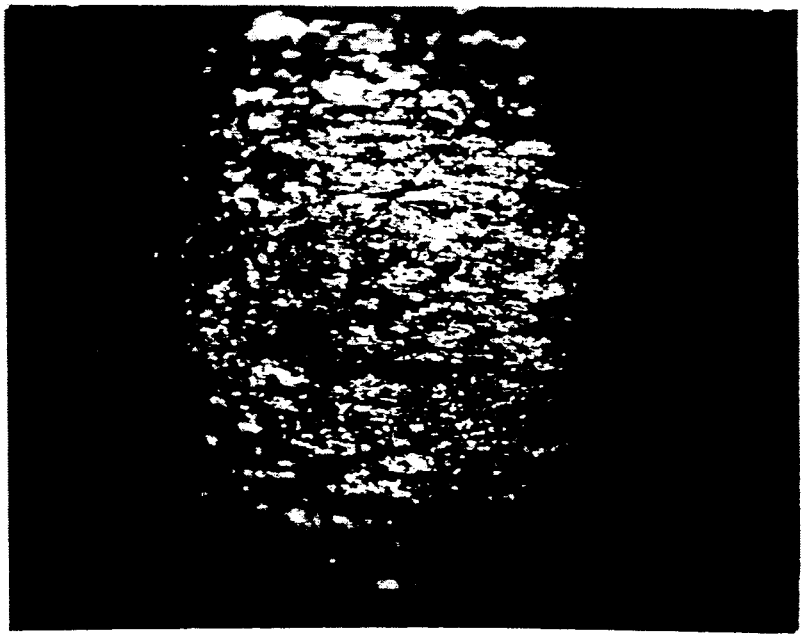
FIG. 5 is a photomicrograph of a ball bearing tested with a Kaiser activated alumina coating.

FIG. 1 is a photomicrograph of an unused ball bearing to serve as a reference. The ball bearing tested on the activated alumina coating of this invention is shown in FIG. 2 and is essentially identical to the unused ball bearing, indicating that the coating provides excellent abrasion resistance. On the other hand, the coatings containing $\alpha$-alumina (FIG. 3) or magnesium silicate (FIG. 4) show a high degree of abrasion. As seen in FIG. 3, the $\alpha$-alumina coating abraded to such an extent that a flat section can be seen on the ball bearing. The coating incorporating Kaiser activated alumina (FIG. 5) also shows a significant degree of abrasion.

We claim:

1. A process for forming a hydrophilic, substantially non-abrasive coating on the surface of a metal article, which comprises contacting the metal surface with particles of substantially amorphous activated alumina obtained by flash calcination of hydrated alumina to form a continuous coating thereon which contains the flash activated alumina in a sufficient quantity to produce the desired properties.

2. The process according to claim 1, wherein the metal is aluminum.

3. The process according to claim 2, wherein the article is a heat exchanger.

4. The process according to claim 2, wherein the particles of flash activated alumina have sizes of less than 10 microns.

5. The process according to claim 4, wherein the particles of flash activated alumina have sizes of less than 2 microns.

6. The process according to claim 5, wherein the particles of flash activated alumina are applied to the metal surface in the form of a suspension.

7. The process according to claim 5, wherein the particles of flash activated alumina are applied to the metal surface dispersed in an organic binder resin.

8. An article of manufacture formed of a metal presenting a surface which has been rendered permanently hydrophilic by a continuous water-insoluble, substantially non-abrasive coating thereon containing particles of substantially amorphous activated alumina obtained by flash calcination of hydrated alumina in a sufficient quantity to produce the desired properties.

9. An article of manufacture according to claim 7, wherein the metal is aluminum.

10. An article of manufacture according to claim 9, wherein the particles of flash activated alumina are within a coating of organic binder resin on the metal surface.

11. An article of manufacture according to claim 10, wherein the coating has a thickness of less than 20 microns.

12. An article of manufacture according to claim 11, wherein the coating has a thickness of about 2–5 microns.

* * * * *